United States Patent [19]

Miro

[11] 4,370,828

[45] Feb. 1, 1983

[54] WINDOW FRAME ASSEMBLY

[76] Inventor: Carl F. Miro, 1805 Atoka Avenue, Youngstown, Ohio 44511

[21] Appl. No.: 196,594

[22] Filed: Oct. 14, 1980

Related U.S. Application Data

[60] Division of Ser. No. 914,568, Jun. 12, 1978, Pat. No. 4,246,731, which is a continuation-in-part of Ser. No. 765,262, Feb. 3, 1977, abandoned.

[51] Int. Cl.[3] ..... E06B 3/38; E06B 1/04

[52] U.S. Cl. ..... 49/383; 52/204

[58] Field of Search ..... 52/204–217, 52/475, 476, 656–658; 49/504, DIG. 1, 381, 383

[56] References Cited

U.S. PATENT DOCUMENTS

| | | | |
|---|---|---|---|
| 2,860,744 | 11/1958 | Mascori | 52/212 |
| 2,902,727 | 9/1959 | Samalis | 52/212 |
| 3,081,849 | 3/1963 | Hubbard | 52/475 X |
| 3,212,140 | 10/1965 | Byrka | 49/383 X |
| 3,340,663 | 9/1967 | Collard | 52/204 |
| 3,455,080 | 7/1969 | Meadows | 52/476 |
| 3,527,011 | 9/1970 | Bloom et al. | 49/504 X |
| 3,750,358 | 8/1973 | Lewkowitz | 52/475 X |
| 3,760,543 | 9/1973 | McAllister | 52/476 X |
| 3,823,524 | 7/1974 | Weinstein | 52/403 X |
| 3,943,679 | 3/1976 | Dissinger | 52/473 |
| 3,969,857 | 7/1976 | Stark | 52/212 X |

FOREIGN PATENT DOCUMENTS

| | | | |
|---|---|---|---|
| 1532282 | 6/1968 | France | 52/204 |

*Primary Examiner*—J. Karl Bell
*Attorney, Agent, or Firm*—Reese Taylor

[57] ABSTRACT

A window frame assembly is disclosed for facilitating the installation of new or replacement windows. The assembly includes a pair of opposed frame sections each having a generally rectangular configuration and appropriate dimensions to conform to the window opening. Each of the sections include opposed top and bottom components interconnected by opposed end components. In one form, locking means are carried by at least the top and bottom components of each of the frame sections so that they may be slid together and snapped in place in the window opening to form a frame assembly about the frame of the window itself. The top, bottom and end components also carry sealing means which are intended to abut and engage the window frame so as to provide a firm seal with the window itself. In one form, at least a portion of the sealing means are also adjustable to accommodate variations in window thicknesses while in another form the sealing means also serve as a thermal barrier. The frame components are L-shaped in cross-section so that one leg may fit against the surrounding building structure thereby presenting a weather tight seal as well as an aesthetically pleasing overall assembly. In a modified form of the invention an expansion member is provided between the frame sections so as to accommodate different wall thicknesses.

12 Claims, 16 Drawing Figures

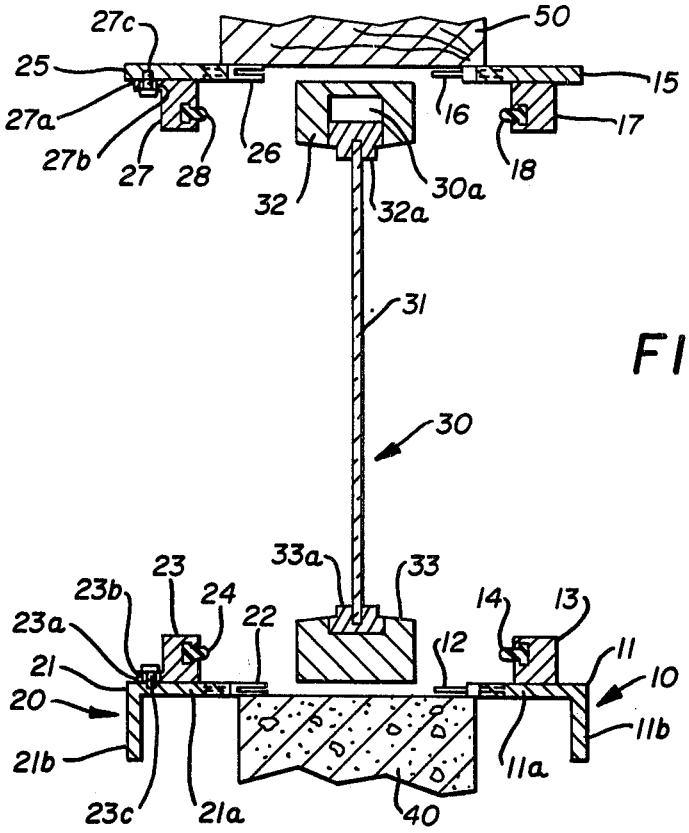
FIG. 3
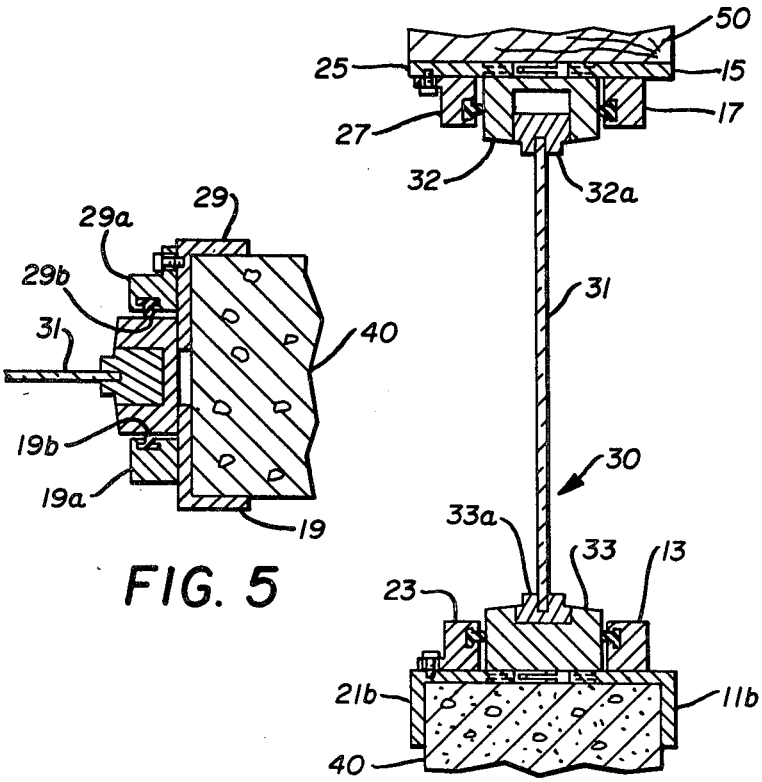
FIG. 4
FIG. 5

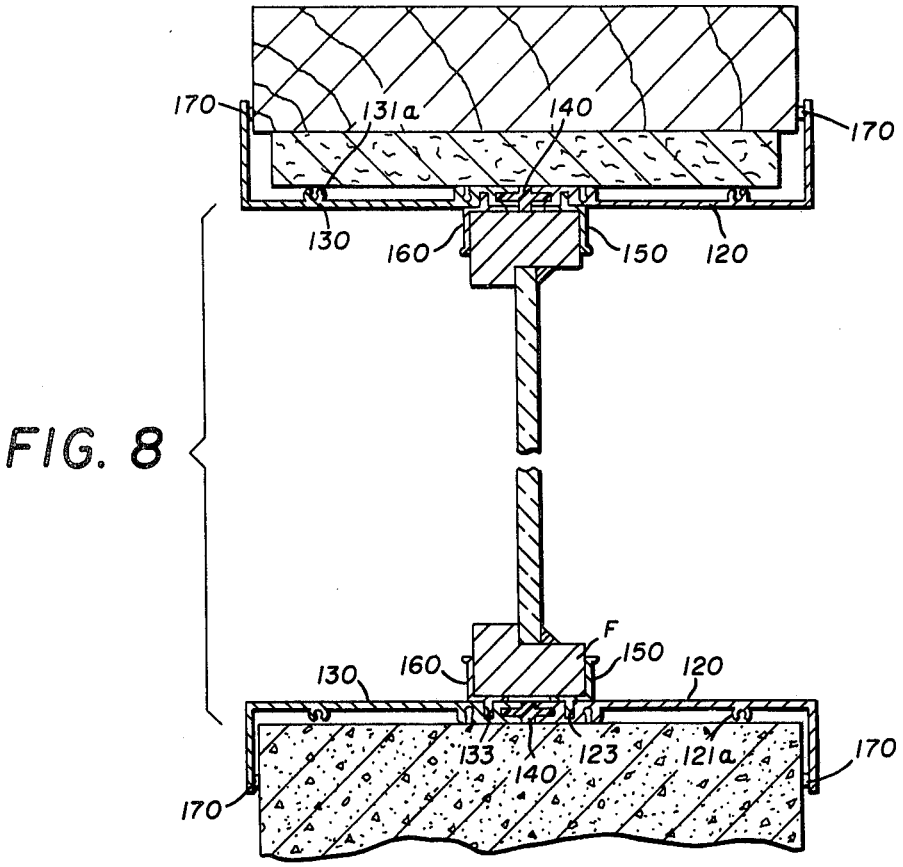
FIG. 8
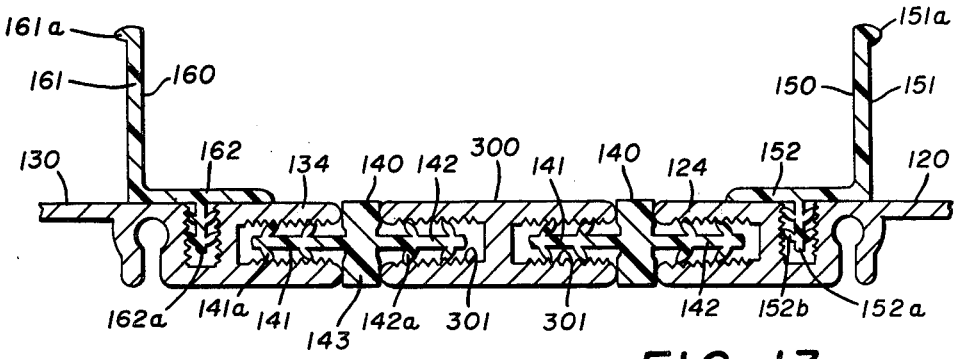
FIG. 13
FIG. 9
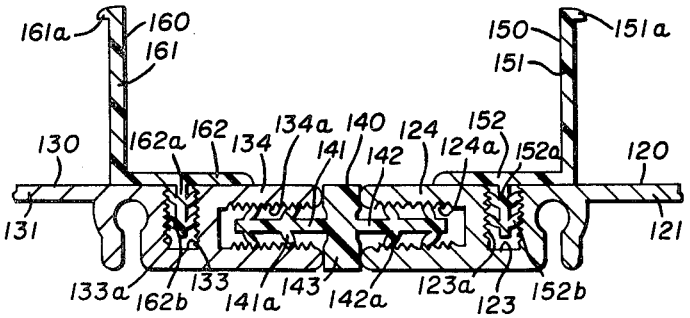

FIG. 10
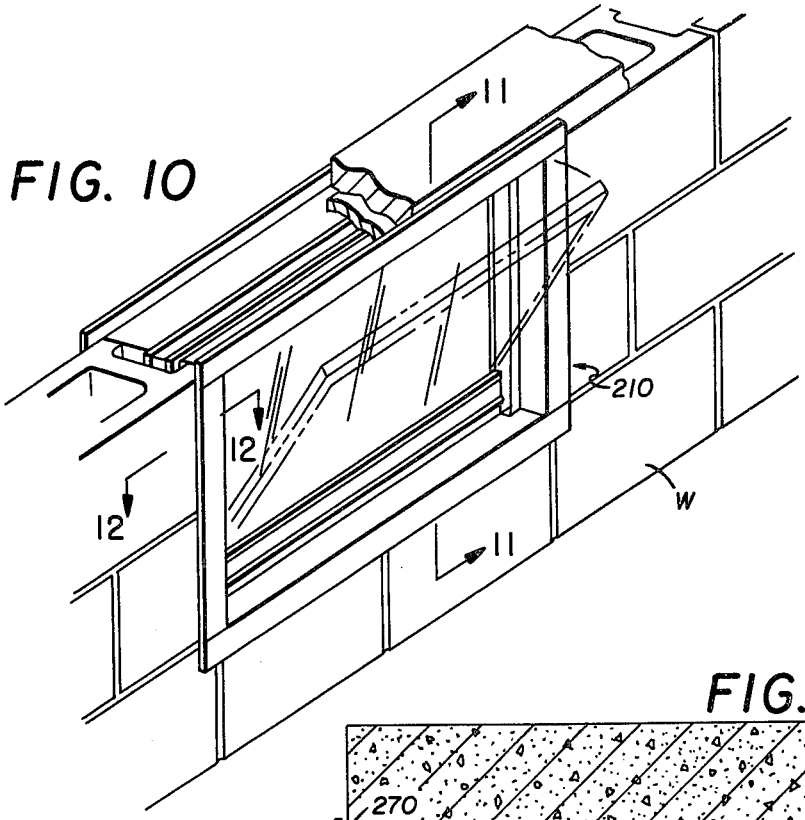
FIG. 11
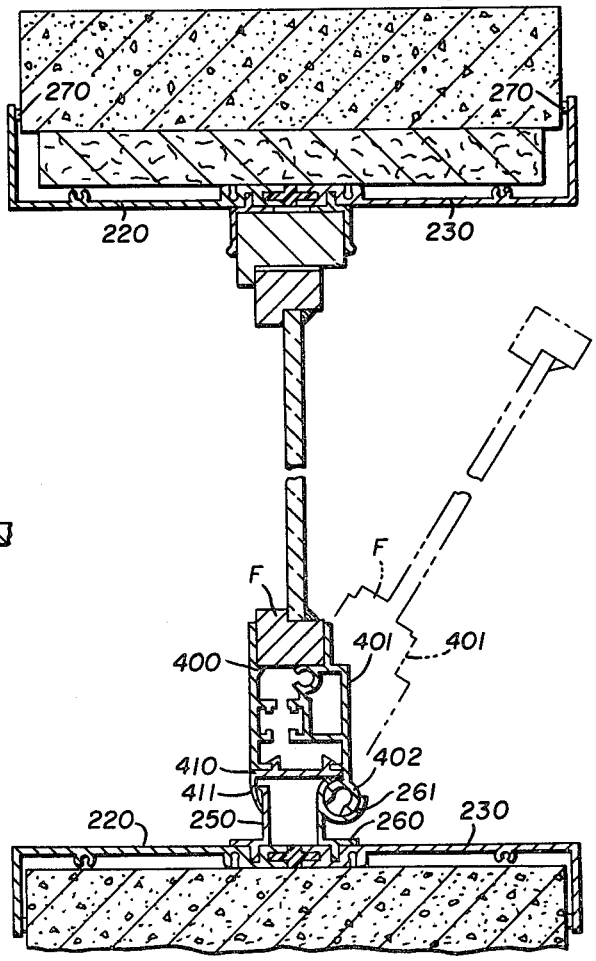
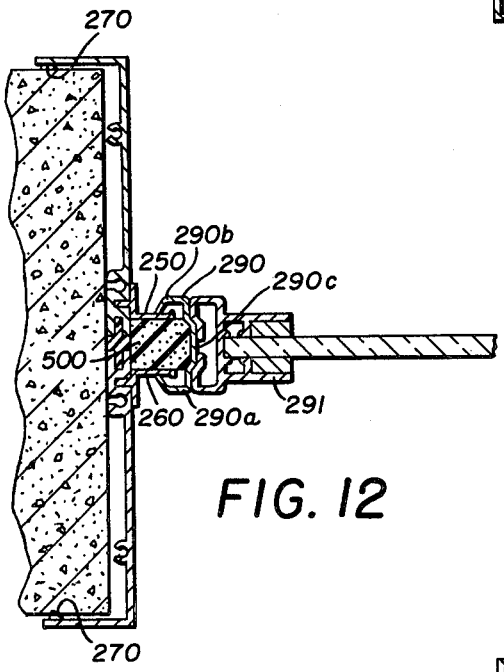
FIG. 12

WINDOW FRAME ASSEMBLY

RELATED APPLICATIONS

This Application is a Division of Applicant's earlier filed, co-pending Application Ser. No. 914,568, filed June 12, 1978, and now U.S. Pat. No. 4,246,731, which was a Continuation-in-Part of Applicant's earlier filed, co-pending, Application Ser. No. 765,262 filed Feb. 3, 1977 and now abandoned.

FIELD OF THE INVENTION

This invention, in general, relates to building construction and in particular relates to an improved window frame assembly intended to accommodate replacement or original windows, primarily in the basement window openings of a building although not limited thereto.

PRIOR ART STATEMENT

In conventional building construction and particularly in constructing the basement of a building, concrete block is laid up and a suitable sized opening is left so that the basement window can be slipped into the opening from the top following which a sill plate is laid over the top of the window. The area around the periphery of the window is then laid up with cement both inside and outside to form a sill and hold the window and window frame in place. While commonly used, this type of arrangement presents a number of problems.

First, the cement sill around the periphery of the window is unattractive and furthermore is susceptible to deterioration and will, in most instances, eventually crack and fall out.

Another disadvantage is that when it is desired or becomes necessary to replace the window, all of the concrete sill must be chipped out and the window pulled out of the opening.

A still further disadvantage is that, at least during original construction, it is necessary to install the windows well before the building is anywhere near final completion because of the fact that the windows are normally slipped in from above and then covered with the sill plate. The difficulty presented by this is that vandalism is fairly common on building sites and the breakage or damage to the glass in a vacant, partially completed building can be quite expensive.

Applicant is also aware of a number of prior art U.S. Patents. For example, Bloom, U.S. Pat. Nos. 3,527,011; Dallaire, 3,731,430 and Gates, 3,868,789 relate to various types of window units per se but none of them provide a window frame assembly capable of accommodating replacement or new windows quickly, cheaply and effectively.

Weistein U.S. Pat. No. 3,823,524 discloses an extrusion which is factory assembled and could not be assembled in situ.

Stark U.S. Pat. No. 3,969,857 discloses different configurations of frame members and also shows locking means which really consist of a screw or screws. This reference presents significant alignment problems in that the screws have to be aligned with the appropriate apertures in the panels. This reference also fails to disclose the adjustability of the sealing means so that both wall thickness and window thickness variations can be accommodated.

Mascari U.S. Pat. No. 2,860,744 discloses an adjustable door frame which really does not hold anything, such as a window, in place. One end of the frame is fixed and the reference clearly does not show adjustable sealing means to accommodate variations in the thickness of the member being held. This is really a decorative facing piece and is not intended to hold a window frame.

Collard U.S. Pat. No. 3,340,663 is simply a device for installing two windows side by side and not for providing a frame for reception of the windows per se.

Millner U.S. Pat. No. 2,841,254 is a selflocking window casing employing a spring-loaded sash locking arrangement.

French Specification No. 1,532,282 also fails to disclose the adjustability of the frame and of the seal to accommodate differing wall and window thicknesses.

Hubbard U.S. Pat. No. 3,081,849 discloses framing members made of extruded metal which can be snapped together at the building site.

Meadows U.S. Pat. No. 3,455,080 discloses plastic extrusions used to form window sash frames.

Lewkowitz U.S. Pat. No. 3,750,358 is a self-locking door molding for affixing glass lights in doors.

McAllister U.S. Pat. No. 3,760,543 is similar to Lewkowitz in disclosing a light unit frame assembly for installing glass in an opening in a door.

Dissinger U.S. Pat. No. 3,943,679 discloses a snap together louver panel assembly.

Samolis U.S. Pat. No. 2,902,727 is also of interest in disclosing means for permanently securing a window frame to a surrounding structure.

SUMMARY OF THE INVENTION

It has been discovered that the aforenoted disadvantages of both the practical and patent prior art can be overcome by providing a pair of frame sections each of which has opposed top and bottom components and opposed end components forming essentially rectangular frames. These can be dimensioned so as to conform to the normal dimensions of a window opening and can be placed into the window opening after the sill plate is in place to hold an original or a replacement window between them.

Provision of frame members of this type makes it possible to install the windows after or almost at the end of the construction period.

It has also been found that these window frame sections can be provided, on at least their bottom and end components, with an L-shaped cross-sectional configuration so as to provide a skirt or flange which can seat against the exterior and interior surfaces of the surrounding structural materials such as the concrete block. In this fashion the usual cement sill and seating is obviated and the skirts provide a weather tight seal which is not subject to deterioration and is aesthetically pleasing.

It has also been found that locking means can be provided on at least the top and bottom components of the frames so that they can be snapped together about the window itself. This can be accomplished at any time and quickly.

It has also been found that sealing means can be provided on the top, bottom and end components of the frame members with these sealing means being capable of contacting the window frame itself on both sides thereof for weather tight sealing purposes. Furthermore, these means can be formed from nonconductive material so as to serve as a thermal barrier.

It has also been discovered that these sealing means can be made to some degree adjustable so as to accommodate variations in window thickness as well as irregularities in the block itself so that, in any event, secure seating and sealing with regard to the window can be achieved.

It has been found that, in a modified form of the invention, a connector or expander can be employed between the opposed frame sections to also provide for varying wall thicknesses.

A window frame assembly having such features will provide a number of advantages.

Installation time will be reduced and the assembly can be installed at any stage of construction or after completion.

The aesthetic properties of the window will be improved without any additional trim.

Use of the thermal barrier sealing means will improve insulation and result in energy savings.

Installation can be made by one man without any alignment problems and without any need for fasteners or cement finishing.

Also, for any given window opening, about 15% more ventilation and light will be provided due to the elimination of the conventional concrete sill.

Accordingly, production of an improved window frame assembly of the character above-described becomes the principal object of this invention with other objects thereof becoming more apparent upon the reading of the following brief specification considered and interpreted in view of the accompanying drawings.

OF THE DRAWINGS

FIG. 1 is a perspective view showing the improved window frame assembly and window in place.

FIG. 2 is a partial perspective view showing the locking means for the lower components of the respective frame members. FIG. 3 is a sectional view taken along the line 3—3 of FIG. 1 with slight exaggerated spacing showing the frame assembly and window prior to final assembly. FIG. 4 is a view similar to FIG. 3 showing the window and the frame assembly after final seating of the window and frame assembly.

FIG. 5 is a sectional view taken along the line 5—5 of FIG. 1.

FIG. 8 is a sectional view similar to FIG. 4 and taken along the line 8—8 of FIG. 6 showing the window and frame assembly after final seating.

FIG. 9 is an enlarged sectional view of the locking and sealing means.

FIG. 10 is a perspective view of a further modified form of the invention for use with a hopper type window.

FIG. 11 is a sectional view taken along the line 11—11 of FIG. 10 showing the modified form of the invention after final seating.

FIG. 12 is a sectional view taken on the line 12—12 of the FIG. 10 showing the side frame structure.

FIG. 13 is a view similar to FIG. 9 showing a further modification showing the expander.

BRIEF DESCRIPTION OF THE PREFERRED EMBODIMENTS

THE EMBODIMENTS OF FIGS. 1 THROUGH 5

Figure 1:
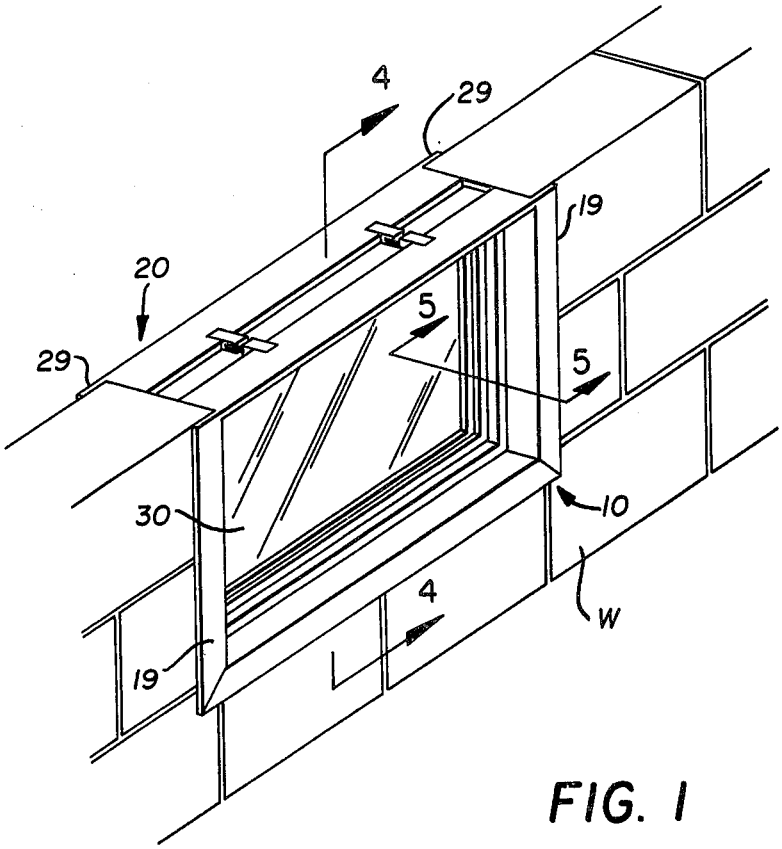

Referring first to FIGS. 1 and 3, it will be noted that this form of the invention, in general, includes a pair of opposed frame sections 10 and 20 each of which has top and bottom components and opposed end components suitable for engagement with the window opening in wall W and with the window 30.

Considering next then FIG. 3 for a more detailed description of the opposed frame sections 10 and 20 and referring first to outer frame section 10, it will be noted that this frame section has a bottom component 11, a top component 15 and opposed interconnecting end components 19,19.

Bottom component 11 is essentially L-shaped in cross-section and has a base leg **11*a* and a depending skirt leg 11*b*. Secured to or integral with the top of the base leg 11*a* is a retainer 13 which receives a T-shaped resilient sealing member 14. Also projecting from one edge of base leg 11*a* is a male locking member 12** which will be described in greater detail below.

The top component of frame section 10 includes a base 15 having a male locking member 16 and a retainer 17 secured thereto or integral with the base. This retainer also receives a sealing member 18 with retainer 17 and sealing member 18 being identical in construction to retainer 13 and sealing member 14 of the bottom component.

The end components 19,19 will not be described in great detail but suffice it to say that they are essentially L-shaped and carry retainers **19*a* and sealing members 19*b* similar to members 14 and 18** so that the sealing members themselves form a rectangular outline about the entire periphery of the outer frame section.

Still referring to FIGS. 3 and 4, the inner frame section 20 also includes a lower or bottom component 21 which has a base leg **21*a* and a skirt or flange leg 21*b* depending therefrom. A female locking member 22 projects from one edge of the base leg 21*a* and a retainer 23 is also provided on top of base leg 21*a* and receives T-shaped sealing member 24**.

The top component of the inner frame section 20 consists of the base 25 and the female locking member 26 as well as the retainer 27 and sealing member 28. Again, the end members 29,29 will not be described in detail but, as illustrated, are L-shaped in cross-section and include adjustable retainers **29*a* and sealing members 29*b*** so that, once again, the seal goes completely around the periphery of the rectangular frame section.

With regard to the inner frame section 20 and particularly with regard to retainers 23 and 27 on the top and bottom components, it will be noted that extensions **23*a* and 27*a* are also provided and these extensions contain elongate slots 23*b*, 27*b*. Screws 23*c* and 27*c* are provided and are capable of being fitted in slots 23*b* and 27*b* and loosened or tightened so that retainers 23 and 27 can be adjusted in a direction normal to the plane of the window 30**. This makes it possible to accommodate different widths of windows and also makes it possible to adjust for variations in the actual width of the window opening which can be caused by misaligned blocks, etc.

Figure 2:
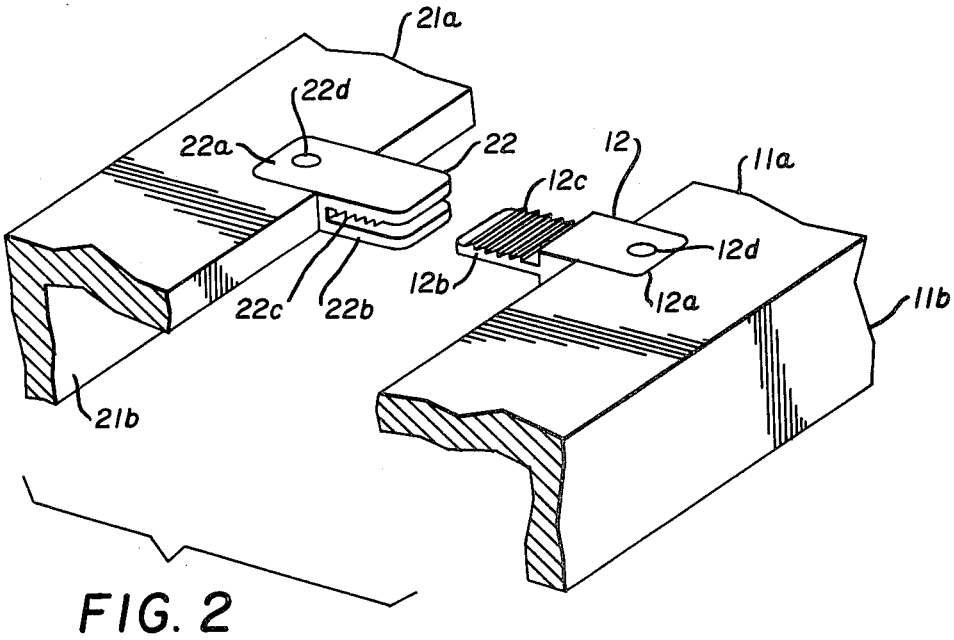

Referring next to FIG. 2 for a detailed description of the male and female locking members, it will be noted that only the locking means of the bottom components 11 and 21 have been illustrated. It should be understood that the locking members 16 and 26 on the top frame components are identical in construction and operation. Furthermore, and referring to FIG. 1, two such locking members are illustrated on the top components but the invention is not intended to be limited to any particular number of these locking members since that may vary, particularly depending upon the actual size of the window involved. Also, it is contemplated that similar locking members could be affixed to the end components either in lieu of the top and bottom components or in addition thereto.

With reference then to FIG. 2, it will be noted that on the male locking member 12 is disposed on one edge of base leg 11*a* and includes a base 12*a* and a projecting portion 12*b*. The projecting portion 12*b* has a serrated or saw-toothed top surface 12*c* and the overall locking member 12 is secured to the base leg of 11*a* by rivet 12*d* or other suitable securing means.

Bottom component 21 of the inner frame section 20 also has a base leg 21*a* to one edge of which the female locking member 22 is secured. This locking member has a base 22*a* and a projecting portion 22*b* with base 22*a* being secured to the base leg 21*a* by a rivet or similar member 22*d*. The projecting portion 22*b* of locking member 22 has a U-shaped configuration on one surface of which is a serrated or saw-toothed configuration 22*c* so that when leg 12*b* of locking member 12 is inserted into the opening of leg 22*b* of locking members 22 the members will engage and normally resist disengagement. In this fashion, the inner frame section 20 and outer frame section 10 can be secured together to form a frame assembly about the window 30.

In use or operation of the invention and assuming a window opening in wall W wherein the lower boundary of the opening is the concrete block 40 and the upper boundary is the sill plate 50 and again assuming that the original window has been removed it is simply necessary to provide the inner and outer frame sections 10 and 20 in the configuration shown in FIG. 3. The window 30, which includes the glass or pane 31 and the upper and lower frames 32 and 33 which hold sashes 32*a*,33*a*, is then disposed centrally between the inside and the outside of the wall W preferably with sashes 32*a*, 33*a* and glass 31 removed. Once this has been accomplished the inner and outer frame sections 10 and 20 are moved together from the position of FIG. 3 to the position of FIG. 4 with the sealing members 14, 18, 24, 28, 19*b* and 29*b* in engagement with the upper and lower frames 32 and 33 of the window 30 for sealing purposes. Engagement of the locking members 12, 22, 16 and 26 will then hold the window firmly in place and the sashes and glass can be inserted.

It is also noted that by utilization of the screws 23*c*, 27*c* the inner sealing members of the top, bottom and end components can be adjusted in a direction normal to the plane of the window 30 and thus can accommodate variations in the thickness of the upper and lower sashes as well as variations in the wall thickness which can be caused by the misaligned blocks for example.

In any event, once the inner and outer frame sections 10 and 20 have been moved to the position of FIG. 4 it will be noted that the depending skirts 11*b* and 21*b* of the bottom components 11 and 21 will be in abutment with the inner and outer surface of the block 40. Similarly the end members 19 and 29 will have their skirts or flanges in similar abutment with the outer surface of the blocks in this fashion an improved aesthetic appearance is provided in that a uniform trim or flange is presented about the periphery of the window both on the inside and the outside. Furthermore, it is possible, if desired, to apply caulking about the periphery of the skirts or flanges for even greater improvement in the air and weather tightness of the overall assembly.

When it is desired to replace a window, it is merely necessary to disengage the sash by moving it upward in space 30*a* until lower sash 33*a* can be moved out of lower frame 33 and the window 30 removed and replaced with a new window. Inner and outer frame sections 10 and 20 need not be disturbed.

THE EMBODIMENT OF FIGS. 6 THROUGH 9

FIGS. 6 through 9 disclose a modified form of the invention embodying many of the general principles of the form of the invention illustrated in FIGS. 1 through 5 as well as the easy and quick assembly, but adding certain features.

Figure 6:
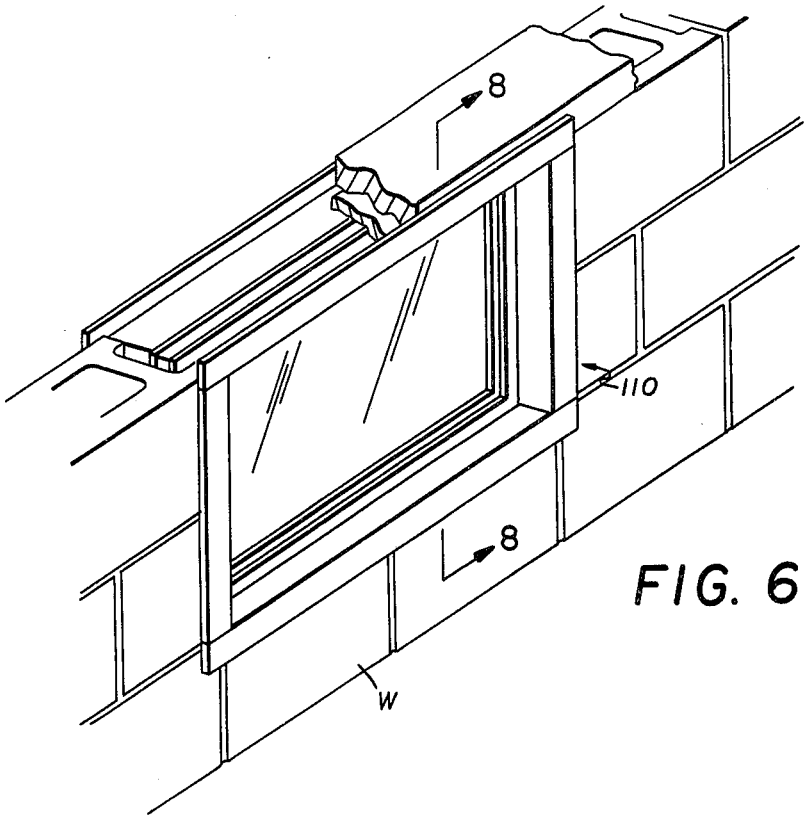
FIG. 6 is a perspective view of a modified form of the invention.
Figure 7:
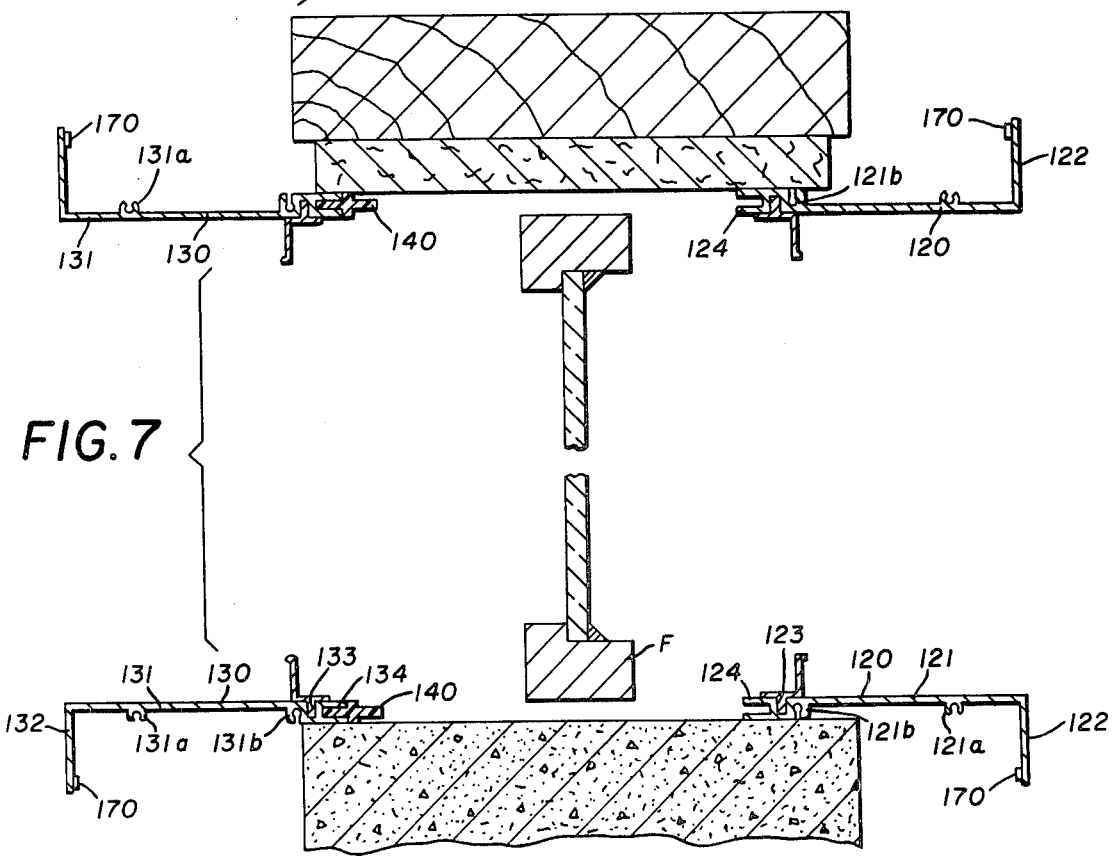
FIG. 7 is a sectional view similar to FiG. 3 showing the modified form of the invention prior to final assembly.

Referring first to FIGS. 6 and 7 them, it will be noted that FIG. 6 is a perspective view similar to FIG. 1 while FIG. 7 is a sectional view similar to FIG. 3 showing the frame sections of assembly 110 positioned just prior to final installation of the window.

In FIG. 7, the frame sections, which are again extruded components forming a rectangular frame, consist of outer frame section 120 and inner frame section 130 and unnumbered top, and bottom end components. In this regard, only the bottom components will be described in detail since the others are identical.

Thus, each of these components of sections 120,130 has a first leg 121, 131 and a right angle leg or flange 122,132.

The horizontal first legs 121 and 131 have longitudinally extending reinforcing ribs 121*a*,121*b* and 131*a*,131*b* respectively for strength.

Also, both horizontal legs 121 and 131 terminate in U-shaped notches 124 and 134. Disposed between the juncture of the vertical and horizontal legs and the notches 124,134 are vertically and longitudinally extending grooves or recesses 123 and 133.

It should be understood that these grooving arrangements extend about each frame and are found in the top and bottom components illustrated in FIG. 7 as well as in the opposed end or side frame components.

Referring to FIG. 9 for a still more detailed description of the outer and inner frame sections 120 and 130, it will be noted that the grooves 123,133 have serrations or sawtooth surfaces 123*a* and 133*a* on their walls.

Likewise, the notches 124 and 134 at the ends of the horizontal legs 121 and 131 also contain serrations 124*a* and 134*a*. As noted earlier, these frame components are constructed of suitable rigid material such as aluminum.

Referring then to FIGS. 8 and 9 to illustrate the manner in which the outer and inner frame sections 120 and 130 are joined together about the window frame F it will be noted that a connector piece 140, which is in the shape of a cross in cross-sectional configuration, is provided for interconnecting the two sections. This member has a main body 143 and opposed projecting legs 141 and 142 and engaging teeth 141*a* and 142*a*. This member may be constructed of vinyl or a similar non conductive material so as to provide insulation between frame sections 120 and 130 and, as illustrated in FIGS. 8 and 9, it is a simple matter to snap the outer frame section 120 to the inner frame section 130 by means of the connector piece 140.

I should also be noted that the main body 143 is preferably rigid while legs 141 and 142 are flexible so as to facilitate engagement with the teeth 124*a* and 134*a*.

It will also be noted from FIGS. 7, 8 and 9 that vinyl thermal barriers and sealing members 150 and 160 are provided to perform two functions. First, these members contact the frame F of the window when the outer and inner frame sections 120 and 130 are joined together to support and hold the frame F (See FIG. 8). The inherent characteristics of the material facilitate this action and make it relatively easy to assemble the components. There members also serve as thermal insulation to avoid the transference of cold, for example, from the outer frame section 120, which is metal and therefore conductive, to the inner frame section 130. This feature is also enhanced by the provision of the vinyl connector piece 140 between the two metal pieces so that there is no metal to metal contact between the exterior of the dwelling and the interior.

These thermal barriers 150 and 160 are essentially L-shaped in cross-sectional configuration and include vertical legs 151 and 161 and horizontal legs 152 and 162. The vertical legs 151 and 161 terminate in outwardly extending lips 151*a* and 161*a* which enhance the stiffness of the vertical legs.

Depending from the horizontal legs 152 and 162 are vertically disposed fins 152*a* and 162*a* and these fins have gripping teeth 152*b* and 162*b* thereon for engagement with the serrations or teeth 123*a*, 133*a* of the grooves 123 and 133 of the frame sections 120,130. In this fashion it is possible to snap the members 150 and 160 into place and the configuration of the engaging teeth will prevent removal of the same.

Again the legs 151, 152 and 161, 162 will preferably be or rigid vinyl while fins 152*a* and 162*a* are flexible to facilitate engagement with teeth 123*a* and 133*a*.

Assembly of the modification shown in FIGS. 6 through 9 is essentially the same as that described above in connection with the form of the invention illustrated in FIGS. 1 through 5 and will not be repeated here.

It will also be noted that legs 122 and 132 optionally have a strip of spring tape 170 on their inner surfaces. This is a compressible material which engages the surface of wall W to form an air tight seal around the periphery of the assembly. Since the surfaces of the wall W are normally rough and uneven, contact between legs 122, 132 and the wall surface will not always be a complete surface to surface contact and use of tape 170 enhances this contact. This feature can be employed with all forms of the invention and also provides the additional advantage of "gripping" the wall so that the assembly cannot slide or move once it is installed in the opening.

The form of the invention illustrated in FIGS. 6 through 9 is essentially intended to be utilized with windows of the "fixed lite" type wherein the windows either do not open or if they open, consist of two overlapping frames which slide over one another along the longitudinal axis of the window itself.

However, where a "hopper" type window is employed some further, slight modification is desirable.

THE EMBODIMENT OF FIGS. 10 THROUGH 12

Referring to FIG. 10 for consideration of the modified assembly 210 it will be noted that outer and inner frame sections 220 and 230 are employed and their construction is essentially identical to that of the frame illustrated in FIGS. 6 through 9 and a detailed description of the same will not be repeated herein.

It should be noted, however, that the bottom component of the inner section 230 receives a modified thermal barrier 260 while outer section 220 receives a thermal barrier 250 identical to the member 160 illustrated in FIG. 9.

The members 250 and 260 are secured to the bottom components of sections 220 and 230 in the same fashion as in FIGS. 6 through 9 and no detail has been illustrated. Also, the thermal barriers and sealing members associated with the top and side components are identical.

However, the inner barrier and sealing member 260 is modified to provide a receptacle for the hinge for the hopper type window. This takes the form of an arcuate socket 261.

It should also be noted that the bottom sash rail assembly 400 is of unique construction. This rail assembly includes an extruded body 401 contoured so as to receive window frame F and terminating in an arcuate engagement member 402 which can be snapped into socket 261 to form a hinge. This permits the window to move from closed to open position as shown in FIG. 11.

The snap engagement between 402 and 261 also permits removal of the window itself if it becomes broken.

A bottom rail seal 410 is also provided for engagement with body 401. This seal is of rigid vinyl and terminates in a flexible seal strip 411 which overlies the top of thermal barrier as sealing member 250.

Additionally, since the window itself is intended to swing inwardly between open and closed positions, some provision must be made on the side components of the frame assembly to accommodate such movement.

To this end, the inner and outer thermal barriers and sealing members such as 250,260 are constructed identically with that of the earlier forms of the invention. However, a compressible resilient member such as a foam member 500 is interposed in the space between them and covered by a generally U-shaped cap 290 which has opposed legs 290*a* and 290*b* which snap over the flanges of the thermal members. This cap has a top surface 290*c* which is contoured so that, as the window is moved from the closed position to the open position (See FIG. 11), the sash rail 291 will slide down over the contoured surface forcing the cap down along the sides of the thermal barriers to permit the window to be moved out of the closed position. The contoured top surface 290*c* also permits the window to ride along these surfaces during the closing operation compressing the foam member and permitting the window to be snapped shut.

The edge of the sash rail 291 of the window conforms to the configuration of cap 290 so that, when the window is closed, an air-tight seal will be accomplished.

THE EMBODIMENT OF FIG. 14

Figure 14:
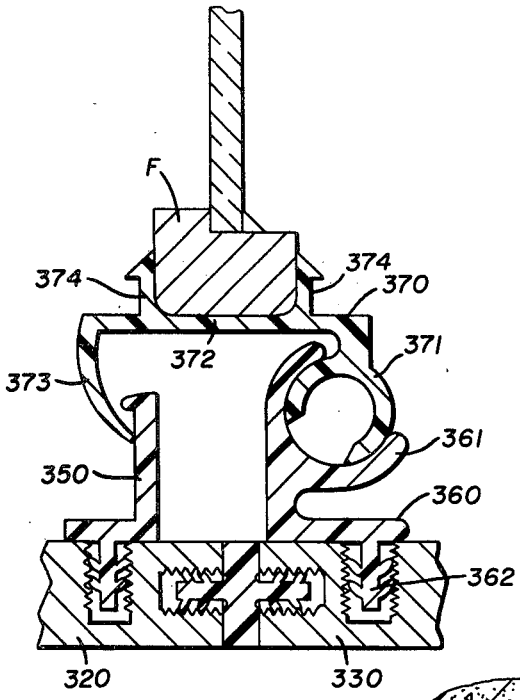
FIG. 14 is a partial sectional view showing a further modified hopper type window support.

FIG. 14 shows a further modification of the means for interconnection between a hopper type window and the frame assembly.

The outer thermal barrier and sealing member 350 is identical to that described above.

Inner thermal barrier and sealing member 360 has been slightly modified in that fin 362 is offset slightly so that when the window is installed, as will be described, it will be centered.

In this embodiment the sash rail assembly 400 and seal 410 have been replaced by a simplified bottom rail seal 370. Seal 370 has a horizontally disposed body 372 and upwardly projecting legs 374,374 which receive window frame F.

Depending from one end of body 372, which is rigid, is a flexible sealing strip 373 which overlies thermal barrier and sealing member 350 for sealing purposes. Depending from the opposed end is a hinge member 371 which can be snapped into socket 361 of thermal barrier and sealing member 360.

THE EMBODIMENT OF FIG. 13

Since the width of the block or other supporting structure will sometimes vary, provision has also been made to accommodate such variations.

FIG. 13 is a view similar to FIG. 9, but illustrating an expander 300. This is a metallic piece having opposed U-shaped openings 301,301 on its opposed edges. These openings have serrations or teeth for engagement with connectors 140,140 and the method of assembly is the same as with the forms of the invention shown in FIGS. 6 through 12 and 14 except that an additional connector 140 is employed.

THE EMBODIMENT OF FIGS. 15 AND 16

When utilizing hopper type windows, of the type illustrated for example in FIG. 11, it is desirable to have a locking arrangement to retain the window in its closed position and it is also advantageous to be able to retain the window in varying degrees of openness.

Figure 15:
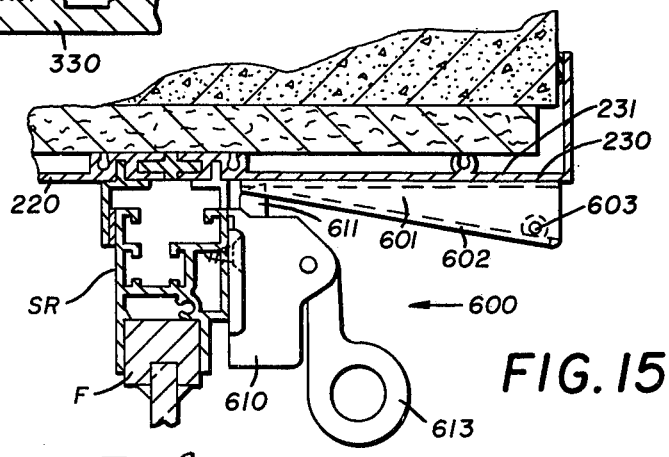
FIG. 15 is a partial sectional view of a window lock assembly for a hopper type window.

To that end, and referring to FIG. 15, a latching and locking assembly 600 is provided. Attached to the frame component 230 is a latch base 601. The specific means of attachment are not illustrated since it is believed apparent that the base 601 could be secured in any fashion to the surface of the leg 231 of the component 230. Pivotally attached as at 603 to the base 601 is a latch keeper 602 which has an aperture at its outboard end designated by the numeral 604.

Secured to the upper sash rail SR is the actual lock 610 which includes a body which carries a spring activated plunger 611 and a handle 613 attached to the plunger so that the plunger, which is normally urged out of the body by the spring (not shown), can be retracted by actuation of the handle 613.

FIG. 15 illustrates this structure with the window in the locked position and with the keeper 602 being engaged by the plunger 611 so as to lock the window in the closed position.

Figure 16:
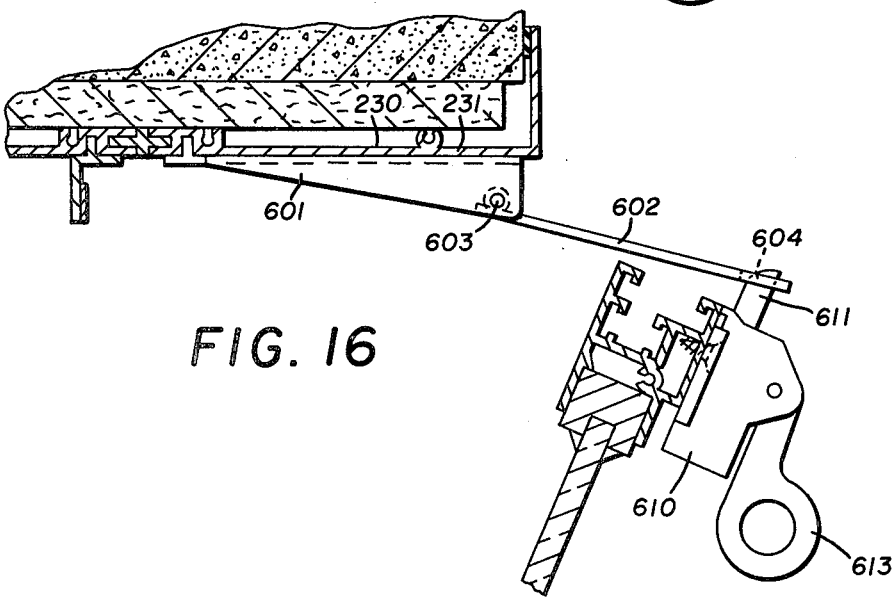
FIG. 16 is a view similar to FIG. 15 showing the window in open position.

When it is desired to open the window or move it to the position of FIG. 16 for example, it is simply necessary to actuate the handle 613 retracting plunger 611 and sliding it down along the surface of the latch keeper 602. When the window is moved to the position of FIG. 16, release of the handle 613 permits a plunger 611 to engage the aperture 604 in the keeper 602. The window will then be retained in its partially open position. If further opening is required, it is simply necessary to disengage the plunger 611 and the keeper 602 which will permit the window to open to its fullest extent.

Finally, as noted earlier, in all forms of the invention, it is possible to provide a compression tape on the inner surface of the frame components. This is a foam or sponge-like member fixed to the frame and referred to by numbers 170 (FIGS. 6 through 8) and 270 (FIGS. 11 and 12). When the assembly is in place, the tape will press against the block and forms an additional seal of the assembly relatively of the wall.

While a full and complete description of the invention has been set forth in accordance with the dictates of the Patent Statutes, it should be understood that modifications can be resorted to without departing from the spirit hereof or the scope of the appended claims.

Thus, while the invention has basically been described in the context of replacing an existing window, it has equal applicability and advantages in new construction as well.

Furthermore, while the invention is not intended to be limited to specific materials, it is contemplated that, for example, the frame sections would be extruded aluminum or a similar material while the sealing and locking members would be made of a non conductive material such as vinyl. Also, as noted above, the number of locking members in the embodiment of FIGS. 1 through 5 is to some degree optional although the actual size of the window opening involved will to some degree dictate that.

The invention is also not intended to be limited to any particular number of locking members in FIGS. 1 through 5. For that matter, it would be possible to have only one locking member on opposed components of frame members 10 and 20 extending either throughout their length or at least a substantial portion thereof.

Furthermore, the invention is not intended to be limited to utilization with the type of single pane window illustrated. In this regard the invention discloses a basic four sided frame assembly capable of accommodating any known type of original or replacement window.

Finally, while the invention has essentialy been described in conjunction with window openings in the basement of a building, it is believed apparent that the same principle could be employed in other areas as well.

What is claimed is:

1. A frame assembly for reception of a window in a window opening formed in a wall, comprising:

(A) a pair of rigid frame sections each having
  (1) opposed top and bottom components and
  (2) opposed end components interconnecting said top and bottom components adjacent their ends to form a rectangular frame section;

(B) locking means carried by at least some of said components in opposed relationship for engagement with each other and interconnection of said frame sections;

(C) sealing means disposed on said top, bottom and end components of said frame sections;

(D) at least some of said sealing means being interconnected to said frame of the window by intermediate means;

(E) said top, bottom and opposed end components have elongate channels opening into facing edge surfaces thereof; and (F) a non-heat conducting connector is provided for engagement within said channels.

2. The frame assembly of claim 1 wherein (A) said top, bottom and end components have elongate channels opening into one surface thereof;

(B) said sealing members having a projecting leg for engagement with said channels.

3. The assembly of claim 2 wherein a compression tape is secured to the inner surface of said skirt portions.

4. The frame assembly of claim 2 wherein (A) a resilient member is received between said sealing members of said end components; and (B) a generally U-shaped cap is slidingly received over said sealing members and said resilient members.

5. The frame assembly of claim 2 wherein (A) serrations are formed on the inner surface of said channels; and (B) said projecting legs of said sealing members have serration engaging teeth thereon.

6. The frame assembly of claim 1 wherein an expander is engagable between said top, bottom and end components.

7. The frame assembly of claim 6 wherein (A) said thermal barriers and sealing members of said end components are spaced from each other;

(B) a resilient member is received between said thermal barriers and sealing members of said end components; and (C) a retention cap is slidably received over said thermal barriers and sealing members of said components.

8. The frame assembly of claim 7 wherein said retention cap is U-shaped in cross-section and has a base contoured complementally to the sash rail of the window.

9. The frame assembly of claim 1 wherein (A) one of said sealing means on said bottom components terminates in a socket; and (B) the window has a bottom sash rail having an arcuate engagement member for releasable engagement with said socket.

10. The frame assembly of claim 9 wherein (A) said window has a top sash rail; and (B) a latching and locking assembly is carried by said top sash rail and one of said top frame components.

11. The frame assembly of claim 10 wherein said latching and locking assembly includes (A) a latch base secured to said top frame component;

(B) a latch keeper pivotally secured to said latch base; and (C) a lock having a spring activated plunger selectively engageable with said latch keeper.

12. The frame assembly of claim 1 wherein an expander is engagable between said top, bottom and end components.

* * * * *